United States Patent [19]

Tamol et al.

[11] Patent Number: 4,874,000

[45] Date of Patent: Oct. 17, 1989

[54] METHOD AND APPARATUS FOR DRYING AND COOLING EXTRUDED TOBACCO-CONTAINING MATERIAL

[75] Inventors: Ronald A. Tamol; Jose G. Nepomuceno; Gus D. Keritsis; George H. Burnett, all of Richmond; Richard A. Thesing, Glen Allen; Warren D. Winterson, Midlothian; Walter A. Nichols, Richmond, all of Va.

[73] Assignee: Philip Morris Incorporated, New York, N.Y.

[21] Appl. No.: 74,990

[22] Filed: Jul. 17, 1987

Related U.S. Application Data

[63] Continuation-in-part of Ser. No. 900,715, Aug. 27, 1986, which is a continuation-in-part of Ser. No. 740,325, Jun. 3, 1985, Pat. No. 4,632,131, which is a continuation-in-part of Ser. No. 627,407, Jul. 3, 1984, abandoned, which is a continuation-in-part of Ser. No. 723,883, Apr. 16, 1985, Pat. No. 4,625,737, which is a continuation of Ser. No. 457,505, Dec. 30, 1982, Pat. No. 4,510,950.

[51] Int. Cl.[4] ..... A24B 3/14

[52] U.S. Cl. ..... 131/375; 131/294

[58] Field of Search ..... 131/299, 294, 295, 375

[56] References Cited

U.S. PATENT DOCUMENTS

| | | |
|---|---|---|
| Re. 24,424 | 2/1955 | Samfield . |
| T912,011 | 4/1973 | Harpham et al. . |
| 2,433,877 | 3/1948 | Wells . |
| 2,485,670 | 2/1949 | Sowa et al. . |
| 2,845,933 | 9/1958 | Samfield . |
| 3,012,562 | 6/1961 | Merritt . |
| 3,042,552 | 5/1962 | Rosenberg et al. . |

(List continued on next page.)

FOREIGN PATENT DOCUMENTS

| | | |
|---|---|---|
| 0113595 | 7/1984 | European Pat. Off. . |
| 0167370 | 1/1986 | European Pat. Off. . |
| 1167717 | 6/1964 | Fed. Rep. of Germany . |
| 2552504 | 7/1976 | Fed. Rep. of Germany ..... 131/299 |
| 143799 | 1/1968 | Netherlands . |
| 690838 | 6/1969 | South Africa . |
| 0275420 | 9/1951 | Switzerland . |
| 282369 | 5/1926 | United Kingdom . |
| 909272 | 10/1962 | United Kingdom . |
| 1055445 | 1/1967 | United Kingdom . |
| 1397923 | 6/1975 | United Kingdom ..... 131/299 |
| 2064296 | 4/1980 | United Kingdom . |

OTHER PUBLICATIONS

"Microwaves Dry Pasta" Food Engineering Apr. 1979, pp. 95–96.

Schiffmann "The Applications of Microwave Power in the Food Industry in the United States" Journal of Microwave Power 8/2/73, one page.

"Drying" one page.

*Primary Examiner*—V. Millin

*Attorney, Agent, or Firm*—Robert M. Isackson

[57] ABSTRACT

Apparatus and a method for processing hot, moist extruded tobacco-containing materials as they are continuously extruded by drying the extruded material rapidly with microwave energy, and then cooling the extruded material rapidly so that the surface temperature of the extruded material is decreased below the bulk temperature to provide the extruded material with an adequately rigid and stable dimensionally structure that can be formed into a smoking article. Microwave drying provides substantially uniform drying without case hardening the material. Cooling may occur by passing air at high velocity, refrigerated air or presenting a partial vacuum across the advancing extruded material, or contacting the material with cold contacting members or a cryogenic bath. Conventional maker devices can be used for forming smoking articles from the dried and cooled extruded material. The invention is useful particularly to process foamed, extruded materials into smoking articles which can be used with conventioanl cigarette maker equipment to produce large quantities of foamed, extruded tobacco-containing smoking articles having properties substantially equivalent to those of a conventional cigarette.

43 Claims, 1 Drawing Sheet

U.S. PATENT DOCUMENTS

| | | |
|---|---|---|
| 3,085,580 | 4/1963 | Muth . |
| 3,098,492 | 4/1963 | Wurzburg . |
| 3,141,462 | 9/1964 | Block et al. . |
| 3,203,432 | 3/1965 | Green . |
| 3,223,090 | 4/1965 | Strubel et al. . |
| 3,364,935 | 1/1968 | Moshy et al. . |
| 3,404,691 | 10/1968 | Moshy et al. . |
| 3,406,690 | 10/1968 | Moshy et al. . |
| 3,410,279 | 11/1968 | Moshy et al. . |
| 3,467,109 | 9/1969 | Block et al. . |
| 3,528,434 | 9/1970 | Halter et al. . |
| 3,760,815 | 8/1973 | Deszyck . |
| 3,894,544 | 3/1975 | Egri . |
| 3,931,824 | 1/1976 | Miano et al. . |
| 3,932,081 | 1/1976 | Buchmann et al. . |
| 3,968,804 | 7/1976 | Kelly et al. . |
| 3,980,744 | 9/1976 | Cogswell . |
| 4,083,371 | 4/1978 | Beringer et al. . |
| 4,164,948 | 8/1979 | Beringer et al. . |
| 4,333,484 | 6/1982 | Keritsis . |
| 4,340,072 | 6/1982 | Bolt et al. . |
| 4,347,855 | 9/1982 | Lanzillotti et al. . |
| 4,391,285 | 1/1983 | Burnett et al. . |
| 4,425,289 | 1/1984 | Lee et al. . |
| 4,506,684 | 2/1985 | Keritsis . |
| 4,510,950 | 9/1985 | Keritsis et al. . |
| 4,516,590 | 6/1985 | Teng . |
| 4,557,057 | 12/1985 | Weiss . |
| 4,578,878 | 4/1986 | Mizuta et al. . |

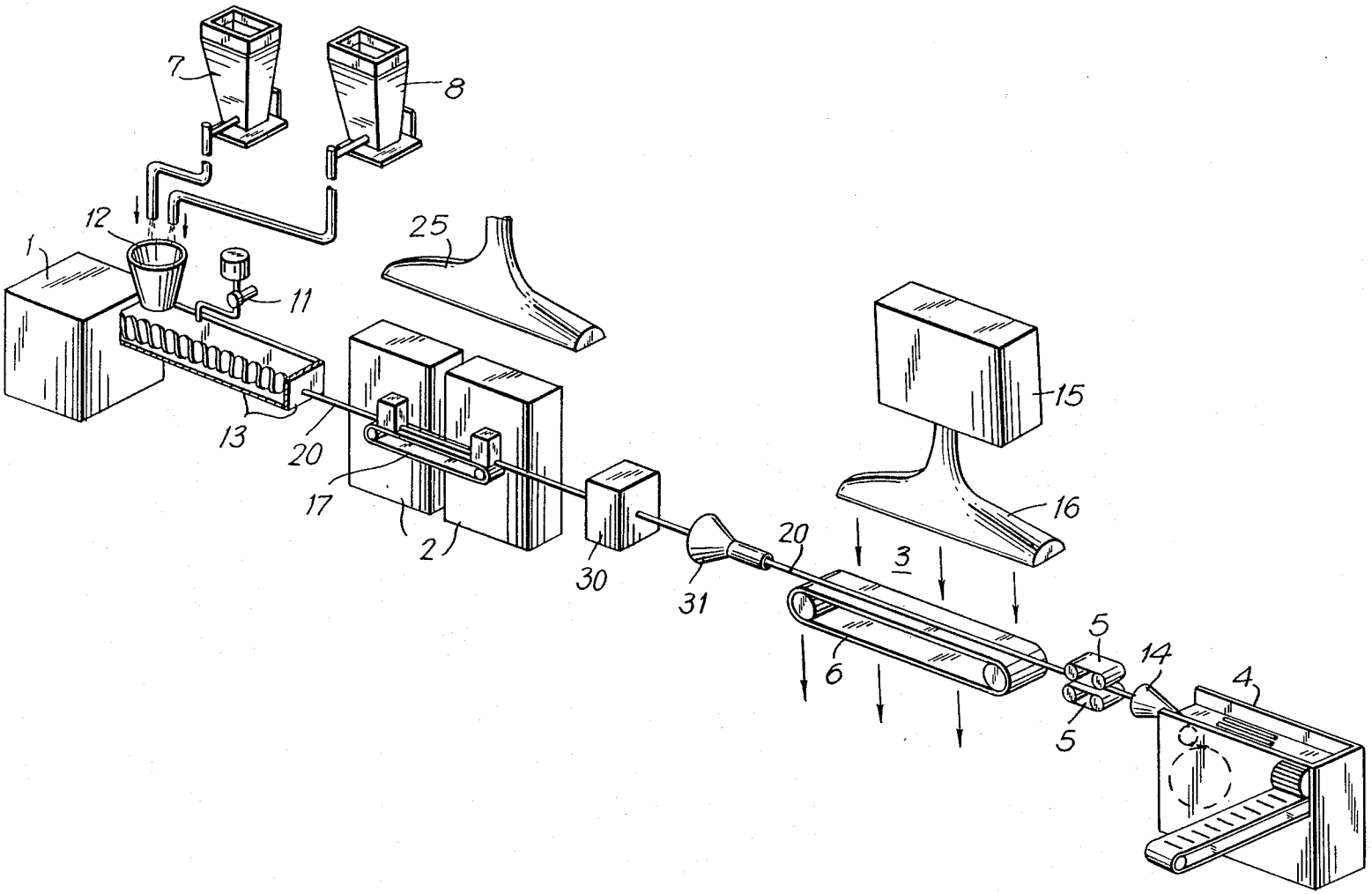
4
14
5
5
15
16
3
6
20
31
30
25
2
8
17
20
11
13
7
12
1

METHOD AND APPARATUS FOR DRYING AND COOLING EXTRUDED TOBACCO-CONTAINING MATERIAL

CROSS REFERENCE TO RELATED APPLICATIONS

This application is a continuation-in-part of application Ser. No. 900,715 filed Aug. 27, 1986 by Ronald A. Tamol, Gus D. Keritsis, Richard A. Thesing, Jose G. Nepomuceno, George H. Burnett, Warren D. Winterson, and Walter A. Nichols entitled Method And Apparatus For Drying And Cooling Extruded Tobacco-Containing Material, which is a continuation-in-part of application Ser. No. 740,325 filed June 3, 1985, now U.S. Pat. No. 4,632,131, by George H. Burnett, Richard A. Thesing, Gus D. , Jose G. Nepomuceno, Alline R. Wayte, and Alex S. Gergely entitled Foamed, Extruded, Coherent Multistrand Smoking Article, which issued as U.S. Pat. No. 4,632,131 and is a continuation-in-part application of application Ser. No. 627,407 filed July 3, 1984 by George H. Burnett, Gus D. Keritsis, Alline R. Wayte, and Jose G. Nepomuceno entitled Foamed, Extruded, Coherent Multistrand Smoking Articles, now abandoned, and this application is a continuation-in-part application of Application Ser. No. 723,883 filed Apr. 16, 1985 by Gus D. Keritsis, George H. Burnett, Richard A. Thesing and Walter A. Nichols entitled Foamed, Extruded Tobacco-Containing Smoking Article, which issued as U.S. Pat. No. 4,625,737 and is a continuation of application Ser. No. 457,505 filed Dec. 30, 1982 by Gus D. Keritsis and Walter A. Nichols entitled Foamed, Extruded, Tobacco-Containing Smoking Article And Method Of Making The Same, which issued as U.S. Pat. No. 4,510,950.

BACKGROUND

Manufactured tobacco and smoking articles are well-known. See, e.g., U.S. Pat. Nos. 235,885; 235,886; 2,433,877; 2,445,338; 2,485,670; 2,592,553; 2,598,680; 2,845,933; 3,012,562; 3,085,580; 3,098,492; 3,141,462; 3,203,432; 3,209,763; 3,223,090; 3,298,062; 3,313,003; 3,353,541; 3,364,935; 3,373,751; 3,404,690; 3,404,691; 3,410,279; 3,467,109; 3,528,434; 3,529,602; 3,760,815; 3,894,544; 3,931,824; 3,932,081; 4,083,371; 4,233,993; 4,333,484; 4,340,072; 4,347,855; 4,391,285; Re. 24,424; U.S. Defensive Publication No. T912,011; German Publication Nos. 1,167,717, 1,532,104, 1,782,854, 2,358,657, 2,410,168, and 2,633,627; Canadian Patent No. 951,209; U.K. Publication Nos. 282,369 and 2,064,296; Swiss Patent No. 275,420; Belgian Publication No. 828503; South African Publication No. 69/838; Netherlands Publication No. 143,799; and commonly assigned U.S. Pat. No. 4,510,950, issued Apr. 16, 1985. Some of those documents refer to casting or extrusion of sheets, strands or filaments of tobacco-containing materials or to extrusion of tobacco rods containing axially directed air channels. Some of the products are expanded, foamed, or both.

One approach to making a foamed, extruded smoking article is disclosed in commonly assigned U.S. Pat. Nos. 4,510,950 and 4,625,737 and 4,632,131 the disclosures of which are incorporated by reference in their entirety. The smoking article is typically substantially cylindrical and is extruded under conditions such that the water in the wet blend fed to the extruder die is converted to steam, thereby foaming the article. The article is monolithic, that is, it is extruded as a single strand with a diameter of from about 2 to about 35 mm, preferably from about 4 to about 25 mm, typically about 4 to 8 mm if the article is a cigarette.

Another approach is to extrude the wet blend out a die having a plurality of small apertures to form an extruded, coherent, multistrand, tobacco-containing, generally cylindrical smoking article comprising a plurality of co-extruded strands that extend generally along the longitude of the smoking article and are adhered to one another, preferably randomly, so as to leave flow passageways between the strands along the longitude of the smoking article. This approach is disclosed in commonly assigned U.S. Pat. No. 4,632,131. The configuration of the strands and passageways of these foamed articles provide sufficient heat transfer area or sufficient residence time or both for the hot gases drawn towards the proximal end of the smoking article by a smoker to cool and to exit the proximal end at a temperature comfortable for the smoker.

Extruded tobacco materials, particularly the foamed, extruded tobacco materials discussed in U.S. Pat. Nos. 4,625,737 and 4,632,131, are formed from tobacco particles, binder, water, and optionally fillers or other desired additives. They are generally hot, moist, soft, and flexible thermoplastic-like materials as they exit the die. The temperature of the extruded materials is typically in the range from 40°–150° C. Working the tobacco-containing material at too high a temperature can result in overworking or cooking of the material, which degrades the quality of the product. Extruding the material at too low a temperature will not foam the material at typical extruder pressures, resulting in too dense a product. The moisture content, measured in terms of oven volatiles or OV, is typically in a range from 15 to 50%, depending on the product formulation and process conditions. This moisture content is above the tobacco equilibrium content of about 10–15%. The terms "moisture content" or OV refers to the solvent in which the tobacco and other materials are mixed before extrusion. Typically, the solvent is water, but organic or alcoholic solvents may be used.

Such continuously formed foamed rod-like extruded materials are too hot, moist, and pliable to be formed directly into smoking articles at high rates of speed by, for example, passing the rods into an automated smoking article "maker" machine such as a Mark 8 Cigarette Maker manufactured by the Molins Company or the like. These materials do not have enough structural integrity to be wrapped and formed into smoking articles without further processing.

The known methods of post extrusion processing of extruded materials include drying the extruded materials to reduce the OV to about the equilibrium OV of tobacco. Drying occurs commonly by allowing the solvent used in the pre-extruded slurry, e.g., water or other agents such as alcohols that aid in evaporation, to evaporate in air at atmospheric or reduced pressures. In some cases suction devices may be used to remove the solvent before drying. In other cases, the extruded materials are dried by infra-red heaters, steam, or hot air, in a conventional drying oven.

The foregoing techniques are inadequate for commercial utilization of continuously extruded materials, particularly foamed extruded materials, because they require long periods of time to reduce the OV to the desired level. These techniques require storage facilities or drying ovens (which can extend hundreds of feet) to sufficiently dry the material, each of which are impractical and costly to maintain in a commercial operation. With very slow rates of drying or low temperature drying, a foamed structure can collapse under its own weight, develop undesirable flat spots against a supporting structure, or otherwise result in a product having a non-uniform density. This adversely affects the burn qualities and consumer acceptance of the smoking article. Attempts to heat rapidly the materials, particularly foamed rods, result in case hardening the outer portions of the extruded material, which in turn inhibits the interior section from drying sufficiently. Case hardening can increase the drying time by an order of magnitude, e.g., from minutes to hours, or hours to days. Over-drying the exterior to dry the interior can result in a brittle product that crumbles when manipulated. Over-drying also can lead to a wrinkled or cracked product or an unduly stiff product, each of which is unacceptable to the consumer.

It also is known to use microwave energy to dry extruded materials somewhat uniformly to reduce the OV to the desired level. However, known microwave drying techniques do not adequately solve the space and time requirements needed to dry continuously advanced foamed, extruded tobacco-containing material into smoking article forming apparatus at high rates of speed in a commercially feasible operation. Moreover, even with known microwave drying, the extruded materials are still too pliable to be formed into the desired smoking article.

Among the objects of the present invention are:

to provide an improved method and apparatus for post extrusion processing of an extruded tobacco-containing material;

to provide a method and apparatus for rapidly processing a continuously advancing, tobacco-containing, foamed, extruded rod-like product for use in apparatus for forming smoking articles at high rate of speed;

to provide a method and apparatus for producing foamed, extruded tobacco-containing smoking articles having a substantially uniform density characteristic;

to provide a method and apparatus for producing extruded, tobacco-containing smoking articles having a uniform circumference, length, moisture content; and to provide a method and apparatus for producing extruded tobacco-containing smoking articles where the solubles are substantially inhibited from migrating to the surface of the articles; and to provide a method and apparatus for producing foamed extruded tobacco containing smoking articles having applied thereto a solid and preferably a powdery material for modifying the characteristics of the extruded material.

SUMMARY OF THE INVENTION

The present invention is directed to drying and cooling extruded tobacco-containing smoking materials rapidly, under conditions that will enable the extruded material to be passed directly from the extruder die to apparatus for forming the smoking material into the desired product. The invention applies to both foamed and unfoamed tobacco-containing extruded material.

The extruded material is first dried to volatize the water or other solvent present in the extruded material and thereby reduce the moisture content to a level at about or preferably below the equilibrium OV level of the tobacco-containing product. Drying also can initiate or continue a foaming operation, when used, by volatizing, gassifying, or decomposing any agent present used to foam the extruded material. Foaming is a result of the moisture, other foaming agent, or gas within the extrudate changing from a super-heated liquid or compressed gas to a gas at essentially atmospheric pressure either as the extruded material leaves the high-pressure environment behind the die inside the extruder and enters the atmospheric environment just downstream of the die openings, or after extrusion, by passing the material through a drying chamber for heating the material so that it foams. The resulting dried material is a hot and pliable thermoplastic material which may be tacky on contact.

After drying, the material is immediately cooled to lower the temperature of the extruded material. Two temperature definitions used herein are (1) surface temperature, i.e., the temperature detected at the surface of the extruded material; and (2) bulk temperature, i.e., the average temperature of a selected quantity of the tobacco material mass after equilibration in a calorimeter. Cooling the dried extruded material requires reducing the bulk temperature at least somewhat and the surface temperature substantially to give the extruded material an adequately rigid structure, to substantially minimize the tackiness of the surface, and to dimensionally fix or set the extruded material for subsequent forming by the maker apparatus.

The temperature to which the extruded material must be cooled to obtain an adequately rigid structure is a function of the specific ingredients of the thermoplastic tobacco-containing mass and the rate of cooling, and will generally be between about −196° C. and 85° C. for the surface temperature, and between about 20° C. and 90° C. for the bulk temperature. In general, the more cooling achieved, the firmer and better the resulting product. Limits on cooling are principally equipment limitations, the heat capacity of the cooling medium applied and how good an insulator the extruded material is. The dried and cooled mass will likely continue to change dimensions very slightly as it equilibrates with ambient or other controlled conditions.

Preferably, cooling reduces the bulk temperature to about, and the surface temperature sufficiently below, the glass transition temperature of the material to provide a case hardened periphery that is semi-rigid for easy handling by automatic maker machines. Unlike the prior art methods, such a case hardening does not interfere with drying the interior of the material or the equilibration of the finished smoking product to the desired conditions because the material is about equilibrated (except thermally) before it becomes case hardened.

Further, cooling the material below the volatization temperatures for the flavor generating components also may prevent certain flavors, both natural in tobacco and added, from volatizing during a long cooling down period. This enhances the subjective characteristics of the finished article. With foamed materials, the surface and bulk temperatures are preferably lowered to below the flash point of the particular foaming agent used, thereby halting any foaming action caused by drying or residual heat stored in the extruded material during the drying step.

The cooled, dried material may then be fed directly into apparatus for producing the desired smoking article. In one embodiment, the tobacco-containing material could be extruded as a sheet which is dried, cooled, and cut up for use as tobacco filler like conventional tobacco leaf or reconstituted tobacco Alternately, and preferably, the material could be extruded in a rod-like shape having a cylindrical cross section and passed directly from the cooling apparatus into the garniture of a commercially available maker. Optionally, the material may be wrapped with cigarette or cigar wrapper or coated with a formulation capable of forming an outer sheath using coextrusion or post extrusion techniques, before being fed to the maker.

A primary advantage of the present invention is the ability to process the hot, moist, pliable extruded material into a material that can be formed into a smoking article on a continuous basis.

In one embodiment, the tobacco containing material includes particles of tobacco mixed in a solvent medium such as water to form a slurry which is extruded, and microwave energy is used to dry the extruded material substantially uniformly throughout the material as it passes through an appropriately dimensioned microwave cavity. The cavity dimensions and microwave frequency are preselected to obtain the required depth of penetration for the given cross sectional area and configuration of the material to excite and volatize the solvent medium and thereby dry the extruded material. The energy level propagated into the cavity is selected based on the rate of advance of the extruded material, the exposure time and OV (or amount of solvent medium) in the extruded material as it enters the drying cavity and the desired OV as it exits the cavity. Optionally, vents may be provided in or adjacent to the microwave drying cavity to exhaust the steam or other vaporized materials generated by the drying action. Thus, the extruded material is dried uniformly, with the vapors generated from the interior portions replenishing the moisture vaporized from the surface regions to give the material a substantially uniform density while reducing the overall OV level to the desired level without case hardening or embrittling the extruded material.

In a preferred embodiment, two spaced apart microwave cavities may be used in tandem to dry the material passing therethrough. Using two cavities permits venting the vapors between the cavities as well as the input and outputs to the drying section, and permits more precise control over the energy level applied to dry the material. Further, the spacing between the cavities can be adjusted to permit the material to equilibrate somewhat between microwave exposures. Also, the orientation of the microwave cavities can be selected, for example, to be oriented in parallel, or with one cavity rotated about the axis of the extruded material relative to the other cavity to better average the microwave energy and modal power distribution within the extruded material. Thus, using two or more microwave cavities permits drying the material more evenly with somewhat greater control than would be possible with a single microwave drying chamber.

Following the drying step, the extruded material is cooled. In one embodiment, the extruded material is passed through a cooling cavity flushed with refrigerated air, preferably exchanged continuously. Ambient air also may be included in the airflow. Refrigerated air, when used, may be generated by, for example, a conventional air conditioning system, passing ambient air over cooling coils chilled to about 4° C., dry ice, or the like. The temperature of the refrigerated air is selected in view of the rate of speed of the extruded material and total exposure time in the cooling chamber to reduce the surface and bulk temperatures of the extruded material sufficiently to fix dimensionally the material for subsequent handling. Thus, the material must be cooled to be adequately rigid for feeding directly to a wrapper and maker apparatus to make smoking articles.

The extruded material may be advanced through the cooling chamber by means that will permit cooling of the extruded material, preferably by a perforated supporting belt or opposing belts permitting continuously exchanged refrigerated (and optionally ambient) air to contact the hot extruded material. Alternately, an air cushion could be used to support the extruded material as it passes through the cooling chamber. Other conventional conveyance means also could be used.

In another embodiment, the cooling step could be conducted by passing the extruded material through a tunnel having a plurality of air jets so that air exiting the jets at high velocity impinges on the surface of the extruded material. The high velocity air passing through the nozzle of the air jets cools to provide cold air impinging on the extruded material. The air input to the plurality of air jet optionally may be refrigerated in order to further increase the cooling capacity of the tunnel by providing high velocity impinging air at temperatures as low as −28° C.

In another embodiment, the cooling step could be conducted by contacting the hot extruded material with a cooled member, such as one or more cooled rollers, a continuously advanced cooled belt, or cooled particulates. In yet another embodiment, cooling could be achieved by contacting or spraying the hot extruded material with a liquid, such as water or alcohol, nitrogen, or a solid, such as dry ice particles, that will vaporize on contact (substantially without being absorbed) and thereby cool the material. In yet another embodiment, cooling could be achieved by passing the material through a cryogenic chamber that contains, for example, liquid nitrogen. In any case, the contacting temperature or quantity of cooling material applied is selected in view of the overall residence time to provide the desired uniform cooling. Any of the foregoing methods could be used singly or in combination, as necessary to cool rapidly the exterior surface temperature of the extruded material to provide a structure that is sufficiently stiff to pass the product through a cigarette type maker device. Further, the cooling chamber could be at least partially evacuated to aid in cooling.

Another aspect of the invention relates to further processing of the extruded material as it is dried and cooled by applying to the surface of the extruded material dry powdery materials less than about 14 mesh in size, preferably less than 40 mesh in size, for modifying the characteristics of the extruded material The solid or dry powdery materials may include, for example, dry powdery tobacco of a single variety or of a blend having an OV of less than 15%, spices or other flavorings, or inorganic or organometallic salts, e.g., $CaCO_3$, or fillers (e.g., carbon, $Al_2O_3$, $TiO_2$, silicates and the like) or hydrocolloids. A wiper or sizing die may be used to remove excess powdery particles, evenly distribute the particles on the surface of the extrudate, and embed the particles in the surface of the extrudate, thereby reducing particle fall-out, the surface porosity of the rod, or both.

Incorporating such a solid or powdery material in the extruded rod reduces the stickiness of the extrudate to the apparatus and makes it easier to process. Incorporating flavor materials to the surface of the extruded rod improves the flavor and subjective room aroma of the smoking articles as compared to adding flavorants to the extruder mixing chamber prior to extrusion, and also allows for using a lesser amount of flavoring material. In one embodiment, a smoking article could be formed from an extruded material having high resistance to draw and low tar coated with a powdery material, whereby the flavor and desirable subjective attributes of the smoking article are predominately supplied by the powdery coating. This could result in a reduced tar smoking article having all the desired subjective qualities of a conventional higher tar smoking article.

Powdery materials that have a tendency to become film forming with heat, moisture, or both may be used, typically in conjunction with a wiper means located downstream of the coating applicator, to reduce the porosity of the extrudate surface to allow for fabricating smoking articles that do not require wrapping. Such a wiper or sizing die may be heated to facilitate spreading and film forming or dispersions of thermoplastic or meltable coatings. Alternately, when the article is to be wrapped, a powdery material such as $CaCO_3$ or tobacco could be applied to reduce the likelihood of the extrudate staining any paper wrapper applied to the extrudate in making paper wrapped smoking articles.

In the preferred embodiment, the extrudate is passed through a box containing the powdery material while the extrudate is sticky, for example, after the extrudate passes out of the microwave drying chamber or the cooling chamber. The powdery material will adhere to the sticky extrudate without requiring the addition of an adhesive agent such as moisture. Typically, the powdery material is agitated, or the box containing the powdery material is vibrated, to ensure that the extruded material is continuously contacted by powdery material as it passes through the box.

DETAILED DESCRIPTION OF THE DRAWING

The FIGURE is a schematic view of an embodiment of the tobacco processing apparatus of this invention.

DETAILED DESCRIPTION OF THE INVENTION

Referring to the FIGURE, an illustrative embodiment of the tobacco processing apparatus of the present invention is shown. The apparatus of the present invention includes drying cavity 2, and cooling chamber 3, placed in tandem, downstream of extruder 1 and the output of extruder barrel 13, and upstream from smoking article forming device 4. Finely divided tobacco materials are input to input port 12 of extruder 1 at a controlled rate, from supply 7. Binder materials also are input to input port 12 of extruder 1 at a controlled rate. Water, from water supply 11, is input to extruder barrel 13 as necessary to maintain the desired moisture content in the mixing chamber. In other embodiments, the materials are mixed in a different order and fed to different input ports as discussed elsewhere herein in connection with prehydration mixing techniques. A means for advancing extruded material 20 through drying cavity 2 and cooling chamber 3 is provided. The advancing means is preferably adjusted to advance extruded material 20 at the selected rate of extrusion with substantially no relative movement between extruded material 20 and the contacting or supporting member of the advancing means. Alternately there may be some relative movement where constant tension on or compression of the extruded material is desirable.

The advancing means may comprise one or more conveyor belts operating at the same linear speed. The conveyor may be a supporting belt, a single belt that is folded about to envelope the extruded material, or opposing belts configured to retain and advance the material. In the embodiment shown in the FIGURE, following drying means 2 is box 30 containing a dry powdery material to be applied to the extrudate passing through box 30, and wiper 31, for removing excess powdery material and spreading and embedding the powdery material along and in the extrudate surface. Box 30 contains an agitating means (not shown) that keeps the powdery material loose and flowing. Following the cooling section, puller means 5 may be used to feed and advance the leading edge of extruded material 20 into extruded material receiving funnel 14 attached to the input of conventional smoking article maker device 4. Puller 5 may be disengaged once the extruded material is advancing directly into maker device 4. In an alternate embodiment (not shown) box 30 and wiper 31 maybe located downstream of cooling means 3.

The method of the invention comprises drying the wet and pliable extruded tobacco-containing material in drying means 2 to about or below the ambient or other controlled level of moisture for the tobacco-containing material, cooling the dried extruded material in cooling means 3 to lower the surface temperature of the extruded material below the bulk temperature to form the tobacco containing material into an adequately rigid material that can be wrapped and severed cleanly into smoking articles. The surface temperature is typically lowered to between about −196° C. and 85° C. and the bulk temperature lowered to between about 20° C. and 90° C. Cooling provides the surface that extends about the periphery of the extruded material with a case hardened semirigid structure so that it can be thereafter severed and formed into smoking articles by maker device 4.

In one embodiment, the method of the invention includes mixing together finely divided tobacco materials, binder materials, water (or other solvent) and other desired additives in extruder 1 to create a thoroughly mixed slurry, extruding the slurry out the die at the end of the mixing chamber or barrel 13 of extruder 1 to form a cohesive extruded material, preferably having a rodlike configuration, drying the extruded material in drying cavity 2, cooling the extruded material in cooling chamber 3, and advancing the extruded material into maker device 4 for forming the desired smoking articles of, for example, substantially uniform dimensions.

In the preferred embodiment, the method of the present invention is adaptable for use in forming foamed extruded smoking articles comprising (a) from about 5 to about 98 wt. % of tobacco particles having a particle size of up to about 5 mesh, (b) from 0 to about 60 wt. % of a filler having a particle size of up to about 350 μm, (c) from 0 to about 1.0 wt. % of a residual foaming agent, (d) from about 2 to about 40 wt. % of a binder selected from the groups of (1) cellulosic binders consisting of hydroxypropyl cellulose, carboxymethyl cellulose and its sodium, potassium, and ammonium salts, crosslinked carboxymethyl cellulose and its sodium, potassium, and ammonium salts, hydroxyethyl cellulose, ethyl hydroxyethyl cellulose, hydroxypropyl methyl cellulose, methyl cellulose, ethyl cellulose, and mixtures thereof; or (2) natural binders, modified natural binders, and synthetic binders consisting of pectin and its ammonium, sodium, and potassium salts, starch, guar, locust bean gum, chitin, chitosan, and derivatives thereof, hemicellulose, xanthan, curdlan, a salt of xanthamonas gum, carageenan, alginic acid and its ammonium, sodium, and potassium salts, chitosan and its water soluble salts, oxycellulose, polyvinyl maleic acid polymer and its ammonium, sodium, and potassium salts, micro-crystalline cellulose, dextran dextrin, maltodextrin, fibrous cellulose, and mixtures thereof; or (3) a mixture of cellulosic, natural, modified natural, or synthetic binders, and (e) from about 5 to about 20 wt. % water, the article having a density within the range of from about 0.05 to about 1.5 g/cc.

As used herein, tobacco particles may be any type of particularized tobacco and will generally be comminuted tobacco selected from the group consisting of bright, burley, oriental, and mixtures thereof, comminuted reconstituted tobacco, comminuted stems, tobacco dust or fines, and mixtures thereof. The tobacco may have been previously subjected to a stiffening or expansion process to increase its filling power. The tobacco or a portion thereof also may have been previously subjected to a heat treatment to bring about a weight loss greater than about 10%, and preferably less than 80%. Such a heat treatment thermally degrades the tobacco and results in charred tobacco particles.

When tobacco particle sizes greater than 35 mesh are employed, it may be necessary to add a polyfunctional acid, such as citric or phosphoric acid and their ammonium, sodium, and potassium salts, during formation of the wet blend in order to achieve the desired appearance and foaming of the extruded article. The polyfunctional acid or its salts is added in an amount such that the smoking article contains from about 0.1 to about 15 wt. % thereof, preferably from about 2 to about 10 wt. %. A typical binder combination is 5 wt. % hydroxypropyl cellulose, 2.5 wt. % carboxymethyl cellulose, and 2.5 wt. % starch. Another typical combination is 1 wt. % hydroxypropyl cellulose, 4 wt. % hydroxypropyl guar and 5 wt. % starch.

The article may also include as a filler any particulate material having a particle size of up to about 350 μm that is compatible with the other components of the blend. The filler s preferably selected from the group consisting of calcium carbonate, magnesium carbonate, calcium oxide, magnesium oxide, calcium hydroxide, magnesium hydroxide, metallic aluminum, alumina, hydrated alumina, clay, diatomaceous earth, silica, titanium dioxide, zinc oxide, iron oxides, carbon, carbonized materials (e.g., carbonized tobacco plant parts) and mixtures thereof and preferably is calcium carbonate.

The dried or equilibrated smoking article contains from about 5 to about 20 wt. % OV, preferably from about 8 to about 16 wt. %.

The smoking article comprises a porous structure that permits static burning and the passage of smoke (gas/aerosol) through the article to the smoker. The density of the article is related to the porous structure and the open cellular structure created in a single strand extruded product, or the voids created between the strands in a multistranded extruded product, and an article having a density within the specified range and having either type of air passageway provides good burn rate and transmission of smoke to the smoker.

The smoking articles may also include from about 0.001 to about 1 wt. % of an alcohol in which the cellulosic binder is soluble. That alcohol is selected from the group consisting of ethanol, methanol, isopropanol, n-propanol, and mixtures thereof. The alcohol present in the smoking article may result from adding alcohol during the formation of the article to lower the moisture content of the extrudate at the die or may be residual alcohol as a result of adding flavor casings.

The smoking article may also contain from about 0.1 to about 40 wt. %, preferably from about 0.5 to about 20 wt. %, of a cross-linking or stiffening agent. The stiffening agent which is preferably added prior to extrusion and then cross-linked during extrusion is selected from the group consisting of alginic acid, carboxymethyl chitin, pectinic acid, chitosan, carboxymethyl chitosan, water soluble salts thereof, malto-dextrins and mixtures thereof. From about 0.1 to about 10.0 wt. % of a water soluble salt of calcium, magnesium, and/or aluminum may also be used.

The smoking articles are preferably extruded and formed as generally cylindrical, coherent, single or multistrand articles having a diameter of from about 2 to about 35 mm, preferably from about 4 to about 25 mm. Alternate cross-sectional configurations may be made with an appropriate die, for example, oval, star-shaped, cylindrical, and the like, or shaped appropriately in an additional post-extrusion process. A post extrusion sizing die also may be used. These rods are typically made in conventional cigarette or cigar lengths and may be wrapped with cigarette paper, a cigar wrapper, or a co-extruded shell of combustible material or the like. The articles may be thus marketed as non-filtered "cigarettes" or as "cigars." A conventional filter may be joined to the "cigarette" by tipping paper to form a filtered smoking article.

Various flavorants and/or humectants that are commonly employed in the manufacture of smoking articles may be added prior to extrusion or may be subsequently added to the extruded article, for example, after the drying step or the cooling step. An example of adding flavorants to a smoking material prior to being fed to a maker apparatus is applicable to the present invention and is found in commonly assigned U.S. Pat. No. 4,619,276, the disclosure of which is incorporated by reference in its entirety. The preferred method of adding flavorants is by passing extrudate 20 through box 30 containing a dry powdery material, preferably tobacco of a single type or a blend of tobaccos having an OV less than 15% or some other spice or flavorant, and optionally, spreading the flavorant over the surface of the extrudate by passing the coated extrudate through wiper means 31. Other known methods also may be used, as known to those of skill in the art.

These tobacco containing articles are preferably made by mixing or blending together the tobacco particles with binder, filler, foaming agent, cross-linking or stiffening agent, and any other desired ingredient with water or similar solvent to form a wet blend, and extruding the wet blend through a selected die in accordance with one of the following extrusion conditions such that (1) as the wet blend is extruded in the form of a single strand the moisture or other foaming agent in the blend is converted to steam or other gaseous product so as to foam the extruded material as it exits the die of the extruder; or (2) the wet blend is extruded to form a plurality of strands which are processed in a drying chamber under conditions that cause the moisture or other foaming agent in the extruded material to be converted to steam or other gaseous product, thereby foaming the material. When multistranded extrudates are formed, each strand must be foamed and randomly or uniformly adhered to neighboring strands along their length, either by the foaming action or by the application of an adhesive in post extrusion processing.

Mixing may be carried out in any conventional mixing device and the resulting mixture is to be a wet blend containing from about 15 to about 50 wt. % of water.

As indicated in the FIGURE, the extruded material may be formed by (a) dry blending tobacco particles with binder, filler, foaming agent, crosslinking or stiffening agent, and any other desired ingredient; (b) admixing this dry blend with water to form a wet blend; and (c) extruding the wet blend through a die having one or a plurality of holes in accordance with one of the extrusion conditions set forth above so as to foam the extruded material as it exits the die.

Alternately, the extruded material may be formed by (1) dry blending tobacco particles with filler, foaming agent, cross-linking or stiffening agent, and any other desired ingredient, (2) prehydrating the binder material with water or similar solvent to activate the adhesive character of the binder, (3) admixing the dry blend and the prehydrated binder to form a wet blend, and (4) extruding the wet blend through a die under any of the extrusion conditions set forth above, preferably so as to substantially foam the extruded material as it exits the die.

This procedure is used in conjunction with a twin screw positive mass displacement extruder having multiple feed ports (not shown). Step (2) prehydration is performed by adding the binder materials to a first feed port of the extruder and by adding the water or similar solvent to a second feed port a distance downstream of the first feed port so that as a charge of binder is inserted, it is processed, sheared, and homogenized as it progresses down the extrusion barrels. Then it is admixed with the water as it passes the second port, prehydrating the binder as the materials are displaced down the extruder barrel. Step (1), dry blending the tobacco, filler, and other materials occurs in a conventional mixing device and is added in a blended state to the extruder barrel by a third feed port, a distance downstream of the second port. Thus the prehydrated binder material from step (2) is admixed with the tobacco and other materials from step (1) in a continuous feed process. Because some extruder and mixing apparatus cannot generate the forces necessary to process and extrude the smoking article in accordance with the preferred procedure, it may be advantageous to dry blend with the binder a small amount of tobacco particles, preferably an amount less than 5 wt. % of the tobacco, a small amount of filler, or other added component, and then prehydrate the blended binder and tobacco or other components. The resultant wet blend will have a lower viscosity than if no tobacco or other component were present and may be more easily processed without significantly raising the moisture content of the mass.

Also, because the viscous prehydrated binder can become very sticky and adhere to the mixing equipment, it is advantageous to dry blend with the binder a small amount of tobacco particles, filler material, or both. The amount of tobacco added is preferably less than about 5 wt. % of the tobacco. The dry blend is then prehydrated, resulting in a wet blend that has a reduced tendency to stick to the processing equipment and is relatively easier to process uniformly, as the material progresses from one step to the next.

Alternately, a portion of the binder may be dry blended with the tobacco and the balance of the binder prehydrated. Because of the relative surplus of water or similar solvent (later taken up by the dry blended tobacco and binder), the viscosity will be lower and the mass easier to handle. Although having a somewhat higher OV content than without cross mixing tobacco and binder in steps (1) and (2), the more efficient activation of the binder results in a dryer and stronger extrudate than that made without prehydrating the binder.

Optionally, a foaming agent may be added to the mixture, preferably selected from the group consisting of air, nitrogen, carbon dioxide, nitrous oxide, ammonium carbonate, ammonium carbamate, ammonium and/or sodium or potassium bicarbonate, an azide, a hydrazide, pentane, hexane, heptane, a halogenated fluorocarbon, pyrrole, acetone, ethanol, a peroxide, and azodicarbonamide. Some of these foaming agents may require the addition of an acid or a base for decomposition, and the use of a foam stabilizer and/or a suitable surfactant such as licorice, yucca or yucca extracts, sodium lauryl sulfate, protein hydrolzate etc.

Extruder 1 may be any conventional extruder having input apertures for materials, mixing chamber or barrel 13 for thoroughly mixing the tobacco slurry ingredients and a die output. Typical extruders include, for example, Wenger Model X-20 single screw cooker/extruder, a Manley collet-type extruder, or twin screw extruders such as those made by Werner and Pfleiderer, C. L. Simon, and Baker Perkins (Models MPF-50D and MPF-50L).

The ingredients of the selected tobacco containing slurry are mixed together in accordance with any procedure and extruded as a cohesive mass, preferably as a foamed product. The extruded material, foamed or not, is moist and pliable, typically having an OV content in the range of 17–28%, depending on the processing conditions used. Particular methods, alternate formulations, and additional details regarding foamed, extruded materials are discussed in U.S. Pat. Nos. 4,625,737 and 4,632,131.

The preferred foamed extruded material foams as it exits the die, giving off large quantities of steam, which may have a slight cooling effect on the extruded material, but the bulk temperature will be typically at about, and probably just below, the flash point of the solvent used. These hot, moist materials exhibit little or no rigidity and have tacky surfaces. They deform easily and cannot be wrapped or manipulated into smoking articles having a substantially uniform density or consistancy.

In accordance with the present invention, these extruded materials are immediately passed through drying chamber 2 to lower the moisture content to at about or below the equilibrium moisture content level. Microwave drying is preferred because (1) it dries the material fast and uniformly; (2) it can cause any foaming agent or residual foaming agent present to volatize to foam, or additionally or more completely foam the product; (3) it rapidly dries the material without adversely affecting the foamed structure once all the foaming is complete; (4) it can be used to dry materials extruded at high rates of speed, for example, 50–250 meters per minute, in a short period of time using equipment occupying little floor space, e.g., 3 meters; (5) it is more energy efficient than prior art drying ovens because the energy required to dry the material is applied directly to the material at the necessary energy density and is not wasted in having to also heat long chambers or large volumes of air; and (6) no case hardening occurs as with conventional convection drying ovens.

In the preferred embodiment, where the extruded material is in the range from about 10–20 mm upon exiting the die (8 mm in final diameter), two substantially identical microwave energy sources and cavities are used, for example Model 56F, manufactured by Cober. These models each have a power capacity of about 6 kw and operated at about 2450 MHz. The microwave cavity dimensions also are the same being about 127 mm×82.55 mm×146.05 mm, having the input and output apertures of both cavities in axial alignment and a distance of about 864 mm separates the output and input walls of the two adjacent cavities Equivalent models or a single microwave unit having the equivalent total power capacity may be used in the alternative. For other configurations of extruded materials, e.g., sheets, greater power may be required to dry adequately the extruded material, as may be determined empirically.

Other known frequencies capable of exciting the resonant frequency of the molecules of the moisture or other solvent or foaming agent in the extruded material for volatizing those molecules could be used. Vent means 25 is provided to exhaust the moisture, solvent, or other foaming agent volatized during drying, and foaming, if any, to thereby facilitate drying. Endless conveyor 17, comprising a nonconductive material that does not appreciably interfere with the passage of microwave energy therethrough, e.g., polyester, nylon, etc., may be used to support the extruded material as it passes through the drying cavity.

Cooling chamber 3 may comprise air conditioner 15, air fan 16 and conveyor belt 6. Air conditioner 15 may be any conventional air conditioner capable of providing refrigerated air such as, for example, a Comfort Aire, 3 ton unit, manufactured by Heat Controller Inc., Jackson, Mich. Air fan 16 is designed to distribute the refrigerated air at a selected flow rate along and preferably perpendicular to the path extruded material 20 follows as it advances across endless conveyor belt 6. Conveyor belt 6 is preferably perforated. The distribution of refrigerated air may be relatively uniform or it may be graduated so that there is more or cooler air at one location along cooling chamber 3 than another. In an alternate embodiment, the direction of cool air flow may be incident or parallel to the extruded material. Air fan 16 and air conditioner 15 may be incorporated into a single unit.

In an alternate embodiment, cooling chamber 3 may be air impinging jets such as the Air Miser manufactured by Huestis Machine Corporation, Bristol, R.I. Such a device could be used to impinge air or refrigerated air at high velocity on the surface of the extruded material, through a plurality of air jets, to cool the air and dry and cool the extruded material. Other cooling means could be used such as cryogenic baths, cold contacting members and other techniques for removing heat from the extruded material.

In one embodiment, the drying and cooling are coordinated so that the resulting product has an OV content below the equilibrium OV content. This permits wrapping the extruded material with a conventional wrapper while it is in a more dry condition so that when the extruded material equilibrates, the extruded material will absorb some moisture and expand slightly and tighten against the wrapper. This will substantially prevent the wrapper from falling off the smoking article, e.g., in low humidity environments, and give the product the look and feel of a conventional cut tobacco-filler smoking article.

In yet another embodiment, the dried extrudate also may be passed through a heated die in the presence of a reduced oxygen atmosphere to char or carbonize the extrudate and effect a weight loss of at least 30%, preferably in a range between 50 and 80%. See, e.g., U.S. Pat. No. 4,481,958 for a discussion of carbonizing rod-like material.

The present invention is particularly adaptable to preserving tobacco flavors and characteristics originally present in the tobacco that heretofore have been lost due to volatilization during extrusion and heating. The flavors are preserved by cooling the extruded material rapidly after drying and thereby reducing the temperature below the volatization temperature of the flavors. This minimizes the volatilization of the flavors that previously were lost. Further, flavors or other additives that would not or do not survive the extrusion, foaming, and drying (and, where applicable, charring) conditions and temperatures can be added to the extruded material immediately after the drying or cooling step, without significant loss due to volatization. These additives can be metered onto the passing extruded material in an efficient manner by conventional equipment. In the preferred embodiment, these flavorant materials are applied by passing the extrudate through a box adapted for vibrating at a rate sufficient to prevent the dry powdery material from being packed or bridged so as to not contact the advancing extrudate.

Foamed products create a thermal barrier that somewhat inhibits cooling the interior of the extruded material. By cooling the exterior rapidly, a thermal gradient is created across the cross section. Thus, by maintaining the exterior relatively cooler than the interior, the natural flavors of the original tobacco and any additives or flavors in or added to at least the substantially cooler periphery of the extruded material may be preserved. The loss of flavors from the relatively interior extruded material is therefore less significant and can be compensated for accordingly.

Maker device 4 may be any commercially available cigarette manufacturing device, such as a Mark 8 or a Mark 9 Cigarette Maker manufactured by the Molins Company, or an equivalent Hauni Company model, modified appropriately by, for example, removing the hopper. Other smoking article forming devices (not shown) could include apparatus such as grinders, slitters, shredders or the like used for processing the dried and cooled extruded material, preparatory for use in forming typical smoking products, e.g., pipe, smokeless, cigarette or cigar tobacco. In the preferred embodiment, the extruded material is fed directly from cooling chamber 3 into the garniture of a Mark 8 Cigarette Maker which was modified by removing the chimney section and replacing it with funnel 14 disposed for receiving the extruded material in either a single or multistranded rod-like form, before or after the rod like material is wrapped conventionally, if at all, and fed into the garniture. After the garniture, the rod is severed by the cut off knife into substantially uniform lengths appropriate for formation into smoking articles and removed by the revolving take off wheel for subsequent handling in accordance with conventional cigarette-type smoking article forming methods and apparatus.

Puller apparatus 5 may be a pinch roll feed type puller or a pair of opposing endless advancing belts designed and operated for use in start up conditions for feeding the leading edge of the extruded material into funnel 14. Puller 5 operates to maintain slight tension on the extruded material across cooling chamber 3 during start up. Once the extruded rod has been fed into funnel 14, and into the garniture so that the garniture pulls on the rod, puller 5 is typically disengaged and the opposing belts separated to prevent damaging the extruded material by exerting forces on the material as the material advances. Commercially available pullers are available from Versa Machinery Division, Foster & Allen Inc., Somerville, N.J., e.g., Model CM22.

The driven apparatus, conveyor belt 17, conveyor belt 6, puller 5, maker device 4, and extruder 1 may all be synchronized by a tachometer (not shown) or equivalent timing means to the drying capacity of microwave cavity 2. The drying capacity can be adjusted for the desired process conditions and the desired extruded material moisture characteristics, primarily by changing the power level of microwave energy propagated into the microwave cavities. Additional cooling means may be required at higher rates of speed when large amounts of microwave energy are used to dry the material Thus, for the given rate of advance of the extruded material, and the related residence time of the extruded material in the microwave heating cavity, the desired OV level can be achieved. For example, drying extruded material having about an 8.0±0.1 mm diameter and advancing at about 182 meters per minute from 20% OV to less than 6% OV can be achieved using a total of about 10 kw of power distributed between the two microwave cavities. Using 9 kw of power resulted in an OV content of about 8%.

The method of this invention further contemplates performing the foregoing operations using the described apparatus at high rates of speed so that the tobacco slurry ingredients can be continuously mixed, extruded, dried, cooled, and formed into smoking articles continuously in a single work station area on the factory floor. The foamed extruded material of the preferred embodiment can be produced at rates from zero to in excess of about 250 meters per minutes in a rod of about 8 mm in diameter. These rates are well within the capacity of conventional cigarette maker devices.

To illustrate further the present invention, the following representative examples are presented.

EXAMPLE

The conventional formulation of minute, finely divided tobacco particles, binder materials, and water were fed to their respective input ports of a Baker Perkins Model MPF-50L twin screw extruder. The tobacco was fed at a rate of about 0.82 kg/min of tobacco dust. The binder mixture was 1% klucel, 4% hydroxypropyl guar, and 5% starch, premixed to form a blend that was fed at a rate of 0.09 kg/min. The tobacco and binder were mixed together and added to a common port of the extruder mixing barrel. Water was added downstream at a rate sufficient to maintain about 20–23% OV in the mixing barrel of the extruder. The OV content of the extruded material as it exited the die was measured to be about 17.2%. The bulk temperature was about 130° C. and the surface temperature was about 95° C. The extruded material was passed through twin microwave cavities at a speed of about 124 meters per minute. The drying cavity included a first and second microwave cavity with the first cavity and second cavities set at a combined power level of 7 kw. The OV content of the extruded material as it exited the drying cavity was at about 10.9%. The surface temperature of the extruded material was 61.7° C. and the bulk temperature was 91.7° C. The dried extruded material possessed little or no rigidity.

The extruded material was then passed through a cooling section that was about 4.6 meters long. Refrigerated air chilled to 15.5° C. was generated and blown perpendicular to the extruded material at a velocity of 104 meters per minute. The extruded material was cooled to a surface temperature of about 46.7° C. and a bulk temperature of 85° C. The OV content dropped to 9.9%. At this point, the extruded material possessed sufficient rigidity to be cut and wrapped using the modified Mark 8 maker. The bulk temperature of the resulting wrapped cigarette rods of dried and cooled extruded material was about 57° C.

In the course of experimentation, it was discovered that the total microwave energy absorbed by the extruded material was more important than whether the two microwave cavities produced the same energy level, or which unit provided more power. For example, substantially the same results were found when the first unit produced 3 kw and the second unit produced 4 kw, as when the first unit produced 4 kw and the second unit produced 3 kw. Similar results were found with the power divided into 2 kw in one unit and 5 kw in the other unit. It was also discovered that for every additional kilowatt of microwave energy absorbed, the OV content would be lowered by about 1.2%. Lowering the power similarly resulted in a higher OV content. Typical extrusion rates for the preferred tobacco-containing materials include from 270 to 455 meter/min, but faster or slower rates are possible within the limits of the equipment. These materials can be dried to desired moisture levels of between about 8% and 14% by using from about 5 kw to 10 kw, distributed between the two microwave cavities. Cooling the extruded materials using refrigerated air cooled to temperatures in the range of from about 1° C. to 16° C. and blown across the material at velocities of from about 50 to 150 meter/min was sufficient to cool the dried extruded material for wrapping and forming.

EXAMPLE II

The same materials and conditions of Example I were repeated with the addition of a powder coating box located immediately downstream from the microwave cavity just prior to the cooling chamber. The hot, moist and sticky extrudate was passed through a vibrating box containing the desired powder. The coated extrudate was then passed through a funnel type wiper or sizing die to smear and embed the coating evenly on and in the extrudate surface and to remove any excess powder from the coated surface. Thereafter the extrudate was cooled and wrapped as described in Example I. The powdery material used in separate runs included an individual tobacco powder, a blended tobacco powder, and $CaCO_3$.

EXAMPLE III

The same materials and conditions of Example II were repeated except that the powder coating box and wiper were located immediately downstream from the cooling chamber.

In both Examples II and III the resultant smoking articles were found to have acceptable and improved subjective qualities as compared to the uncoated smoking articles. Experimental results indicate that a combination of different dry powdery materials could be simultaneously used to enhance the flavor and reduce porosity and modify the characteristics of the extruded tobacco containing material.

As various modifications can be made to the method and apparatus of this invention and the material to which this invention pertain, it is intended that all matter contained in the above description or shown in the FIGURE shall be interpreted as illustrative and not in a limiting sense.

We claim:

1. A method for processing continuously extruded tobacco-containing materials, comprising:

drying the extruded material by passing it from the die of the extruder to and through a microwave resonant cavity energized by microwave energy, and propagating microwave energy from a source into the resonant cavity, wherein the microwave frequency is responsive to the resonant frequency of the moisture or other solvent to convert them to a gaseous product; and exposing the extruded material to said microwave energy to reduce the OV level of the extruded material to an OV level at about or below the equilibrium OV level for of the extruded material; and cooling the extruded material so that the surface temperature of the extruded material is decreased below the bulk temperature to provide the extruded material with a structure adequately rigid and stable dimensionally for forming into smoking articles.

2. The method of claim 1 wherein the cooling step further comprises cooling the material so that the surface temperature is decreased substantially below the bulk temperature and the convective heat loss rate from the surface of the material is at least as fast or faster than the conductive heat transfer rate from the interior of the material.

3. The method of claim 1 wherein the drying cavity further comprises more than one microwave energy source and associated resonant cavity, having separately controllable power levels.

4. The method of claim 3 further comprising:

exhausting the gaseous products produced by exposing the extruded material to microwave energy from between adjacent microwave resonant cavities.

5. The method of claim 1 wherein cooling the extruded material further comprises:

generating a supply of cooled air at below room temperature;

contacting the advancing extruded material with the cooled air.

6. The method of claim 1 wherein cooling the extruded material further comprises:

contacting the extruded material with a selected amount of material capable of being vaporized by the elevated temperature of the extruded material; and permitting the material to vaporize and thereby lower the temperature of the extruded material.

7. The method of claim 1 wherein cooling the extruded material further comprises:

contacting the extruded material with a cooled contacting member capable of absorbing heat from the extruded material to cool the extruded material.

8. The method of claim 1 wherein cooling the extruded material further comprises:

passing the extruded material through a chamber capable of creating at least a partial vacuum; and vaporizing the residual solvent or water from the extruded material by applying a vacuum to the surface of the advancing extruded material and thereby cool the extruded material.

9. The method of claim 1 wherein cooling the extruded material further comprises impinging air at high velocities to provide cool air on the surface of the advancing extruded mass.

10. The method of claim 1 wherein cooling the extruded material further comprises passing the extruded material through a cryogenic cooling bath.

11. The method of claim 1 wherein cooling the extruded material further comprises reducing the surface temperature to a temperature in the range between about −196° C. and 85° C. and reducing the bulk temperature to a temperature in the range between about 10° C. and 90° C.

12. The method of claim 1 further comprising wrapping the extruded material with a conventional wrapper material after it has been cooled and before it has been formed into smoking articles.

13. The method of claim 12 wherein drying the extruded material further comprises drying it to a moisture content below the equilibrium moisture content level before wrapping so that when the extruded material equilibrates it will expand against the wrapper to form a tight wrap.

14. The method of claim 1 further comprising adding an additive to the extruded material after the extruded material has been cooled to a temperature below the boiling temperature of the additive, said additive modifying the characteristics of the resultant smoking article.

15. The method of claim 1 further comprising applying a powdery material to the surface of the extruded material after the extruded material has been dried, said powdery material modifying the characteristics of the resultant smoking article and said dry powdery material being selected from among the group consisting of tobacco, spices or other flavorants, inorganic or organometallic salts, fillers, or hydrocolloids.

16. The method of claim 15 further comprising wiping the coated extrudate for spreading the powdery material on the extrudate surface and embedding the powdery material in the extrudate surface.

17. The method of claim 15 wherein applying the powdery material further comprises passing the extrudate through a box containing the powdery material, and agitating the powdery material sufficiently to coat the extrudate completely.

18. A method of making an extruded, coherent, tobacco-containing, generally cylindrical smoking article having a density within the range of from about 0.05 to about 1.5 g/cc and a structure providing sufficient heat transfer area or sufficient residence time or both for the hot gases drawn towards the proximal end of the smoking article by a smoker to cool and to exit the proximal end at a comfortable temperature for the smoker, the method comprising the steps of:

(a) mixing together from about 5 to about 98 wt. % of tobacco particles having a particle size of up to about 5 mesh and an OV value of from about 3 to about 20%, from 0 to about 60 wt. % of a filler having a particle size of up to about 350 μm, from 0 to about 50 wt. % of a foaming agent including any solvent or vehicle other than water, from about 2 to about 40 wt. % of a binder selected from the group consisting of cellulosic binders, natural binders, modified natural binders, synthetic binders, and mixtures thereof, and water to form a wet blend containing from about 15 to about 50 wt. % of water;

(b) extruding the wet blend from step (a) through a die to form an extruded material;

(c) drying the extruded material to reduce the moisture content to at about or below the equilibrium value;

(d) cooling the extruded material and lowering the surface temperature below the bulk temperature, thereby providing the extruded material with a structure adequately rigid and stable dimensionally for forming into smoking articles; and (e) forming the extruded material into smoking articles.

19. The method of claim 18 wherein the extruding step further comprises extruding the wet blend through a die to form an extrudate having a diameter in the range from about 2 to about 35 mm.

20. The method of claim 19 wherein step (b) further comprises extruding the wet blend from step (a) through the die under extrusion conditions of temperature and pressure such that as the wet blend is extruded the moisture or other foaming agent in said blend is converted to steam or other gaseous product so as to foam the material.

21. A smoking article produced according to the method of claim 19.

22. The method of claim 19 wherein step (a) further comprises:

(a) dry blending (i) from about 5 to about 98 wt. % of tobacco particles having a particle size of up to about 5 mesh and an OV value of from about 3 to about 20% with (ii) from 0 to about 60 wt. % of a filler having a particle size of up to about 350 μm, (iii) from 0 to about 50 wt. % of a foaming agent including any solvent or vehicle other than water, and (iv) from about 2 to about 40 wt. % of a binder selected from the group consisting of cellulosic binders, natural binders, modified natural binders, synthetic binders, and mixtures thereof; and (b) admixing the dry blend from step (a) with water to form a wet blend containing from about 15 to about 50 wt. % of water.

23. A smoking article produced according to the method of claim 22.

24. The method of claim 19 wherein step (a) further comprises:

(a) dry blending from about 5 to about 98 wt. % of tobacco particles having a particle size of up to about 5 mesh and an OV value of from about 3 to about 20% with from 0 to about 60 wt. % of a filler having a particle size of up to about 350 μm and from 0 to about 50 wt. % of a foaming agent including any solvent or vehicle other than water;

(b) prehydrating from about 2 to about 40 wt. % of a binder selected from the group consisting of cellulosic binders, natural binders, modified natural binders, synthetic binders, and mixtures thereof; and (c) admixing the dry blend from step (a) with the prehydrated binder from step (b) to form a wet blend containing from about 15 to about 50 wt. % of water.

25. A smoking article produced according to the method of claim 24.

26. The method of claim 24 wherein a relatively small portion of the materials in step (b) in an unhydrated state is added to and dry blended with the dry blend of step (a) to reduce the viscosity of the prehydrated binder from step (b) and to reduce the tendency of the prehydrated binder to stick to the processing equipment.

27. The method of claim 19 further comprising:

adding an additive to the extruded material after the cooling step has lowered the temperature of the extruded material below the volatization temperature of the additive, said additive modifying the characteristics of the resulting smoking article.

28. The method of claim 19 further comprising applying a powdery material to the surface of the extruded material after the extruded material has been firmed, said powdery material modifying the characteristics of the resultant smoking article and said dry powdery material being selected from among the group consisting of tobacco, spices or other flavorants, inorganic or organometallic salts, fillers, or hydrocolloids.

29. The method of claim 28 further comprising wiping the coated extrudate to spread the powdery material on the extrudate surface and embed the powdery material in the extrudate surface.

30. The method of claim 28 wherein applying the powdery material further comprises passing the extrudate through a box containing the powdery material, and agitating the powdery material sufficiently to coat the extrudate completely.

31. Apparatus for processing continuously advancing extruded tobacco containing material having an OV content greater than the equilibrium OV content, comprising:

means for drying the extruded material as they exit the extruder, including a source of microwave energy, a cavity associated with the microwave energy source having an input aperture and an output aperture for passing the extruded material therethrough, and means for propagating the microwave energy into the cavity, said drying means being capable of reducing the OV content of the extruded material to an OV level at about or below its equilibrium moisture level as it exits the output aperture;

means for cooling the extruded material, said cooling means being capable of reducing the surface temperature of the extruded material below the bulk temperature to form a structure adequately rigid and stable dimensionally adaptable for forming into smoking articles; and means for supporting and conveying the extruded means from the extruder through the drying and cooling means.

32. The apparatus of claim 31 wherein said cooling means cools the surface temperature of the extruded material to a temperature in the range from between about −196° C. to about 85° C. and cools the bulk temperature to a temperature in the range from about 20° C. to about 90° C.

33. The apparatus of claim 31 wherein said source of microwave energy and associated cavity, further comprise a first source and associated cavity and a second source and associated cavity, arranged in tandem so that the extruded material passes through the first cavity and the second cavity.

34. The apparatus of claim 31 wherein the cooling means comprises:
a chamber;
a source of refrigerated air; and
a fan for directing the refrigerated air into the chamber and across the advancing extruded material.

35. The apparatus of claim 31 wherein the cooling means comprises:
a chamber;
a supply of cooling material capable of being vaporized upon contact with the heated extruded material; and
means for applying an amount of cooling material to the advancing extruded material at a rate that permits the cooling material to be substantially vaporized upon contact with the extruded material and thereby cool the extruded material.

36. The apparatus of claim 31 wherein the cooling means further comprises:
a refrigerated contacting member capable of absorbing heat from the extruded material;
means for contacting the extruded material with the refrigerated contacting member and thereby cool the extruded material.

37. The apparatus of claim 31 wherein the cooling means further comprises:
a vacuum chamber;
means for passing the extruded material through the vacuum chamber; and
means for applying a partial vacuum to the surface of the extruded material inside the vacuum chamber so that a substantial amount of the residual water or other solvent is vaporized, thereby cooling the extruded material uniformly.

38. The apparatus of claim 31 wherein the cooling means further comprises:
a cryogenic bath; and
means for passing the extruded material through said cryogenic bath to cool the extruded material.

39. The apparatus of claim 31 wherein the cooling means further comprises:
a chamber through which the extruded material passes;
a source of air;
a plurality of air jets disposed about the chamber and arranged to impinge upon the surface of the extruded material; and
means for passing said air through said plurality of jets to impinge upon the extruded material to dry and cool the extruded material in a uniform manner.

40. The apparatus of claim 31 further comprising, means for applying a powdery additive to the extruded material, said additive modifying the characteristics of the resulting smoking article.

41. The apparatus of claim 40 wherein said means for applying a powdery additive further comprises:
a box for containing the powdery additive material, said box having a passageway for passing the extruded material therethrough; and
means for agitating the dry powdery material in the box while the extruded material is passing through the box so as to coat the surface of the extruded material with the powdery material.

42. The apparatus of claim 41 further comprising means for wiping the surface of the coated extruded material to remove excess powdery material and distribute the powdery material on the surface of the extruded material.

43. An extruded smoking article produced in accordance with claim 28.

* * * * *